US006769509B2

(12) United States Patent
Harwood

(10) Patent No.: US 6,769,509 B2
(45) Date of Patent: Aug. 3, 2004

(54) POLE SPEAKER

(76) Inventor: Ronald Paul Harwood, 31110 Applewood, Farmington Hills, MI (US) 48331

( * ) Notice: Subject to any disclaimer, the term of this patent is extended or adjusted under 35 U.S.C. 154(b) by 0 days.

(21) Appl. No.: 10/324,563

(22) Filed: Dec. 19, 2002

(65) Prior Publication Data

US 2004/0118630 A1 Jun. 24, 2004

(51) Int. Cl.[7] ..... A47B 8/06
(52) U.S. Cl. ..... 181/199; 181/198
(58) Field of Search ..... 181/198, 199, 181/203, 205, 207, 208, 209

(56) References Cited

U.S. PATENT DOCUMENTS

| | | | | |
|---|---|---|---|---|
| 1,804,306 | A | | 5/1931 | Bender |
| 3,090,461 | A | | 5/1963 | Gray |
| 3,150,739 | A | | 9/1964 | Dones |
| 3,170,538 | A | | 2/1965 | Detrick |
| 3,326,321 | A | | 6/1967 | Valuch |
| 3,327,808 | A | | 6/1967 | Shaper |
| 3,329,235 | A | | 7/1967 | Shaper |
| 3,486,578 | A | | 12/1969 | Albarino |
| 3,529,691 | A | | 9/1970 | Wesemann |
| 3,750,838 | A | | 8/1973 | Pyle, Jr. |
| 3,818,138 | A | | 6/1974 | Sperrazza, Jr. |
| 3,832,679 | A | * | 8/1974 | Foley et al. ..... 340/928 |
| 3,945,461 | A | | 3/1976 | Robinson |
| 4,063,387 | A | | 12/1977 | Mitchell |
| 4,164,988 | A | | 8/1979 | Virva |
| 4,348,549 | A | | 9/1982 | Berlant |
| 4,451,019 | A | | 5/1984 | Bensel |
| 4,574,906 | A | | 3/1986 | White et al. |
| 4,754,852 | A | | 7/1988 | Mule et al. |
| 4,949,386 | A | | 8/1990 | Hill |
| 4,953,223 | A | | 8/1990 | Householder |
| 5,058,169 | A | | 10/1991 | Temmer |
| 5,444,194 | A | | 8/1995 | Reinke |
| 5,525,767 | A | | 6/1996 | Fields |
| 5,721,401 | A | | 2/1998 | Sim |
| 5,802,190 | A | | 9/1998 | Ferren |
| 5,802,193 | A | | 9/1998 | Kieltyka |
| 5,828,765 | A | | 10/1998 | Gable |
| 5,832,099 | A | | 11/1998 | Wiener |
| 5,946,401 | A | | 8/1999 | Ferren |
| 5,988,314 | A | | 11/1999 | Negishi |
| 5,995,634 | A | | 11/1999 | Zwolski |
| 6,021,208 | A | | 2/2000 | Kin-Lung |
| 6,056,083 | A | | 5/2000 | Daniell |
| 6,335,975 | B1 | | 1/2002 | Yang |
| 6,345,685 | B1 | | 2/2002 | Wells et al. |
| 6,411,721 | B1 | | 6/2002 | Spindler |

* cited by examiner

*Primary Examiner*—Kimberly Lockett
(74) *Attorney, Agent, or Firm*—Brooks Kushman P.C.

(57) ABSTRACT

A speaker assembly is provided for enclosure within a structural pole. The speaker assembly includes a sub-plate adapted to be affixed adjacent to an internal cavity formed in a fixed end of the structural pole. A speaker is mounted to the sub-plate and oriented such that acoustical vibrations provided by the speaker are directed toward an underlying support surface of the structural pole. A resonating chamber member is oriented within the structural pole internal cavity and has an open end mounted adjacent to the speaker. The resonating chamber member is sized to match the speaker.

26 Claims, 4 Drawing Sheets

12
44
10
26
18
W
22
20
16
30
24
32
14
34
36
28

POLE SPEAKER

BACKGROUND OF THE INVENTION

1. Field of the Invention

The present invention relates to speaker assemblies and speaker systems, more particularly to a speaker assembly or speaker system enclosed within a pole or a series of poles.

2. Background Art

Many outdoor and indoor public areas utilize speakers, speaker systems or public address systems for reproducing sound in these areas. These areas may include city streets, parks, residential neighborhoods, office buildings, campus areas, exterior walkways, shopping malls, casinos, and the like. These areas typically utilize speakers or speaker systems that are mounted to existing building structures, structural poles, or the like. Much effort is employed in installation of these systems and protecting these speaker systems from vandalism and/or the weather. Also, efforts have been directed towards protecting the associated wires or cables provided to these speaker systems. The prior art provides a plurality of methods and apparatuses for mounting speakers and speaker systems in public areas. The prior art also provides apparatuses for protecting these speakers from the elements. Further, the prior art has offered solutions for concealing speaker systems in public areas. Many of these prior art solutions may be costly in light of the advantages provided due to manufacturing costs of various components and complex apparatuses for concealing or protecting the speakers. Further, many of these prior art speaker assemblies have a limited directional range in which the sound is conveyed.

A simplified speaker apparatus and system is needed for use in public areas that effectively conceals the speaker apparatus or system and provides a desired quality and amplitude of sound reproduction, omnidirectionally or, if desired, multi-directionally.

SUMMARY OF THE INVENTION

An object to the present invention is to provide a speaker assembly for enclosure within a structural pole. The speaker assembly includes a sub-plate for mounting a speaker proximate to an internal cavity formed in a fixed end of the structural pole. The speaker is directed toward an underlying support surface of a structural pole. A resonating chamber member that is sized to match the speaker, is oriented within the structural pole internal cavity.

Another object of the present invention is to provide the speaker assembly in combination with a structural pole.

A further object of the invention is to provide a speaker system including a series of spaced apart structural poles, each having an internal cavity and a fixed end mounted to an underlying support surface. The speaker system includes a series of speaker assemblies, each being enclosed within one of the structural poles for providing acoustical vibrations to pass out from each structural pole.

Yet another object of the invention is to provide a method for mounting a speaker assembly within a structural pole. The method includes installing a speaker and resonating chamber within each structural pole and adjusting the distance between the speaker and the underlying support surface to tune the speaker assembly.

The above objects and other objects, features, and advantages of the present invention are readily apparent from the following detailed description of the preferred embodiments for carrying out the invention when taken in connection with the accompanying drawings.

DETAILED DESCRIPTION OF THE PREFERRED EMBODIMENTS

Figure 1:
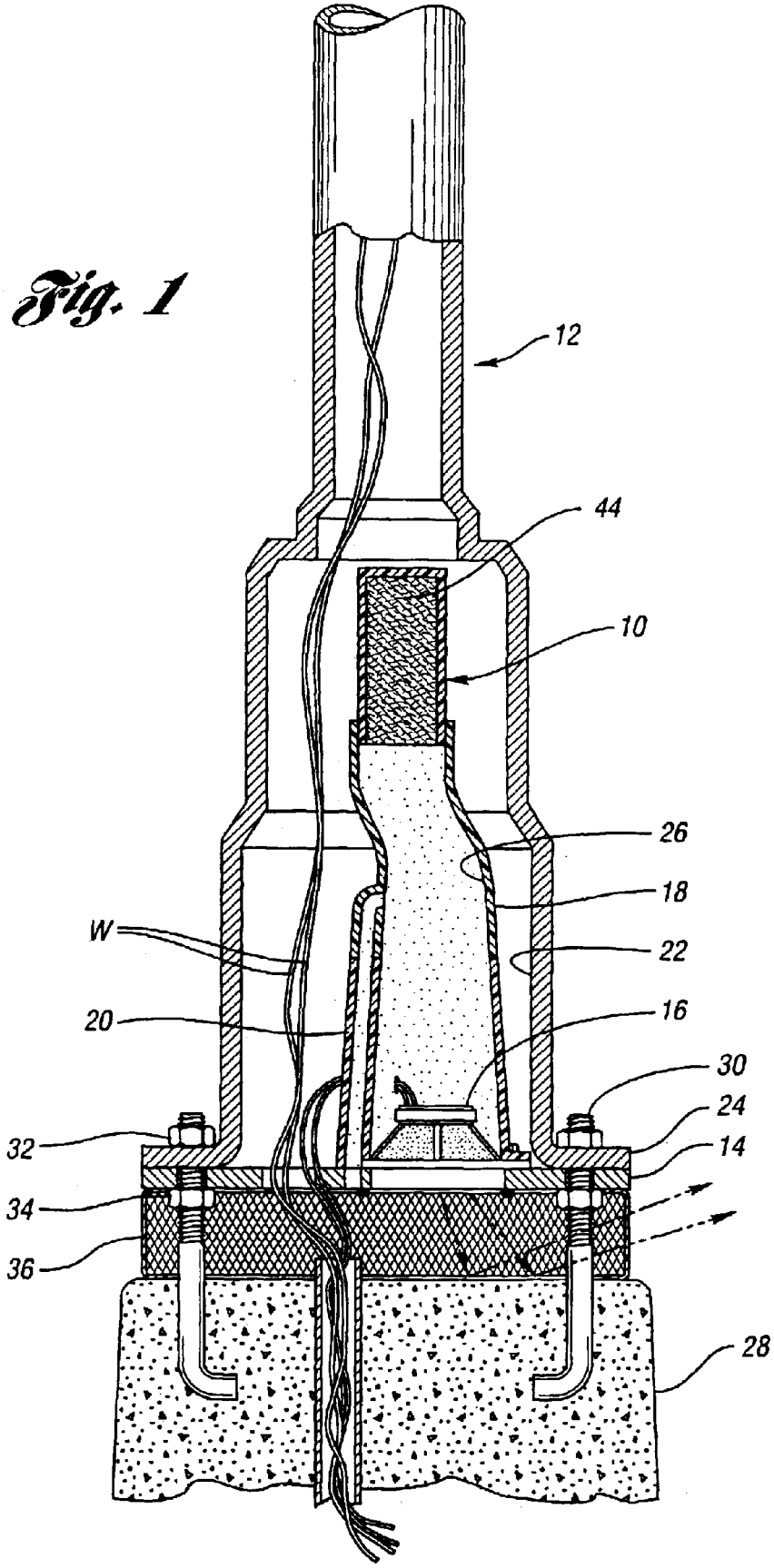
FIG. 1 is a side, partial section view of a preferred embodiment structural pole and speaker assembly in accordance with the present invention.
Figure 2:
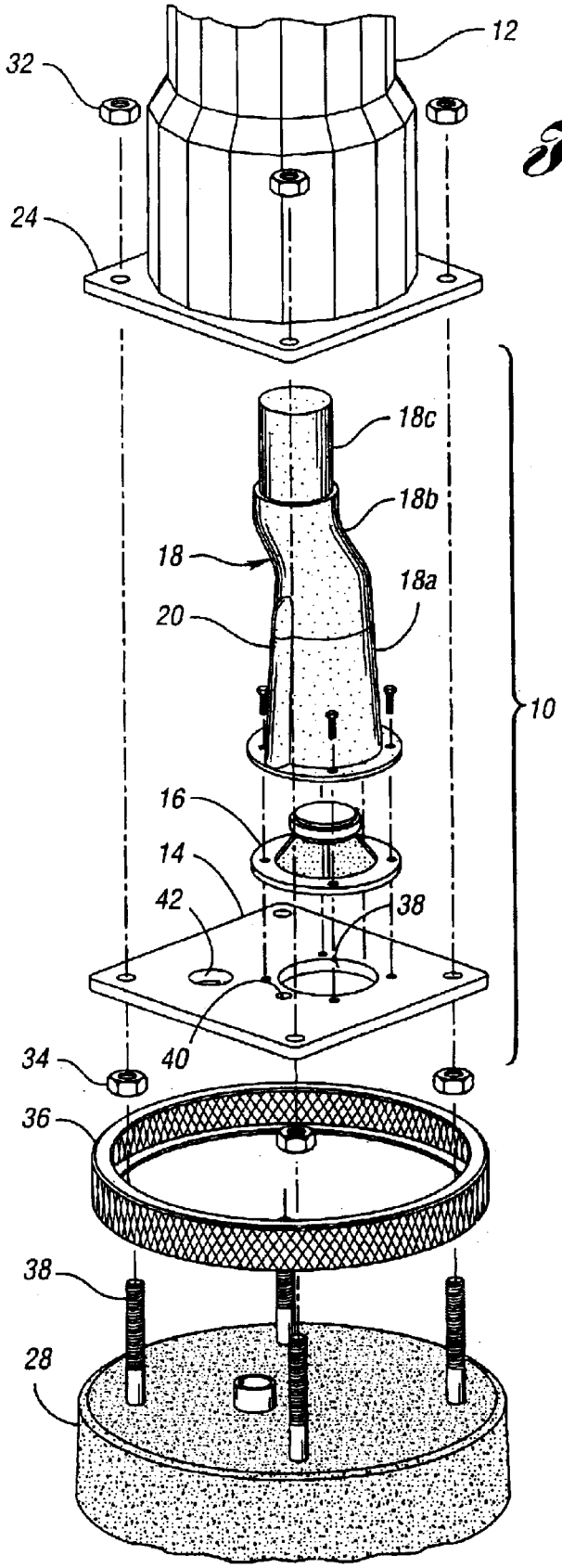
FIG. 2 is an exploded perspective view of the structural pole and speaker assembly of FIG. 1.
Figure 2A:
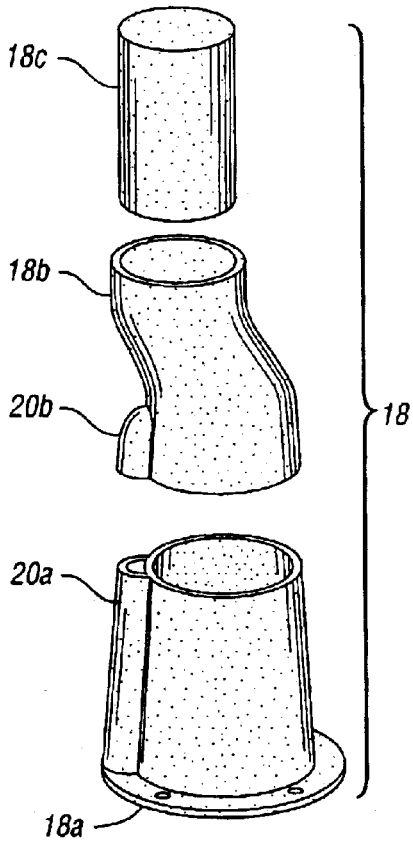
FIG. 2*a* is an exploded perspective view of a resonating chamber member of the speaker assembly of FIG. 1.

With reference now to FIGS. 1, 2 and 2*a*, a preferred embodiment speaker assembly 10 is illustrated enclosed within a structural pole 12. The structural pole 12 may be a street pole, a light pole, a sign pole, or the like. Further, the structural pole 12 may be a conventional prior art structural pole 12, or the structural pole 12 may be designed specifically for this application.

Structural poles 12 are common in public areas wherein speaker systems or public address systems may be utilized. The prior art has provided means for mounting a speaker assembly externally to a structural pole. However, the externally mounted speaker assembly may be vulnerable to vandalism elements or the like. Also, the externally mounted speaker may detract from the visual appearance or aesthetics of the public area. In comparison, the speaker assembly 10 of the present invention is effectively concealed within the structural pole 12. This concealment houses the speaker assembly 10, thus dissuading vandalism or theft while protecting the speaker assembly 10 from the elements, if the structural pole 12 is located outdoors. Morever, a passerby may enjoy an improved aesthetic appearance of the public area while concomitantly enjoying sound reproductions transmitted from the speaker assembly 10.

The speaker assembly 10 includes a sub-plate 14, a speaker 16, a resonating chamber member 18 and a tubular port 20. The sub-plate 14 is adapted to be affixed to the structural pole 12 adjacent to an internal cavity 22 formed in a fixed end of the structural pole 12. Specifically, the sub-plate 14 is illustrated having a footprint and hole pattern to match that of a mounting flange 24 of the structural pole 12. The speaker 16 is mounted to the sub-plate 14 and oriented such that acoustical vibrations provided by the speaker 16 are directed toward an underlying support surface of the structural pole 12.

The resonating chamber member 18 has a wall for defining an elongated internal cavity 26 oriented within the structural pole internal cavity 22. The resonating chamber 18 has an open end mounted adjacent to the speaker 16 for partially enclosing a back surface of the speaker 16. Preferably, the speaker 16 and resonating chamber member 18 are sealed to provide an air tight resonating chamber internal cavity 26. The resonating chamber member internal cavity 26 is sized specifically for the speaker 16. The resonating chamber member internal cavity 26 reflects backward acoustical,vibrations provided by the speaker 16 and amplifies the overall sound reproduction created thereby.

The tubular port 20 is connected to the resonating chamber member 18 and is in communication with the resonating chamber member internal cavity 26. The port 20 is sized to provide fluid resistance to air entering and exiting the resonating chamber member internal cavity 26 in response to acoustical vibrations provided by the speaker 16 for improving the sound quality. Although the tubular port 20 improves the sound quality of the speaker system 10, the port 20 is optional. Without the tubular port 20, the resonating chamber member internal cavity 26 prevents a vibrational overdrive to the speaker 16, similar to a properly sized tubular port 20. Elimination of the tubular port 20, also reduces the manufacturing costs incurred by the inclusion of the port 20.

Conventional structural poles are typically fastened directly to an underlying support surface. An exemplary underlying support surface is illustrated in FIG. 1 as a concrete pier base 28. Pier bases 28 typically include a plurality of J-bolts 30 extending therefrom for attaching the structural pole 12. The J-bolts 30 typically include a hooked end which is inserted into the pier base 28 as the concrete is being cured. The J-bolts 30 also include a threaded end which extends out of the pier base 28. The J-bolts 30 are arranged in a pattern to mate with the hole pattern of a prescribed mounting flange 24 of the structural pole 12. The mounting flange hole pattern is aligned with the J-bolts 30 and the mounting flange 24 is typically secured directly atop the pier base 28 by a plurality of threaded nuts 32. For aesthetic purposes, the structural pole 12 may include a plurality of nut covers (not shown) to enclose the threaded end of the J-bolts 30 and the nuts 32 to prevent tampering and corrosion.

The sub-plate 14 utilizes this fastening hardware for attaching the sub-plate 14 to the mounting flange 24 of the structural pole 12. The sub-plate 14 has a hole pattern consistent with that of the mounting flange 24 such that it may utilize the same hardware, J-bolts 30 and nuts 32 for fastening it to the mounting flange 24. Cooperating hardware, sub-plate 14 and mounting flange 24 are also employed for spacing the bottom of the speaker assembly 10 away from the underlying support surface. A plurality of adjustment nuts 34 are each mounted to one of the J-bolts 30 such that the sub-plate 14 may rest thereupon and space the speaker assembly to therefrom. This spacing is adjusted to a user selected height of the sub-plate 14 relative to the pier base 28 for tuning the speaker assembly 10. Particularly, the speaker assembly 10 is adjusted to an elevation such that acoustical vibrations, illustrated as directional arrows in FIG. 1, transmitted therefrom are reflected from the underlying support surface such that they span a prescribed region ideal for listening. Specifically, this tuning may be performed by spacing the speaker assembly 10 relative to the pier base 28 such that the acoustical vibrations provided by the speaker 16 are reflected in a manner such that the sound reproduction lies in a region proximate to a head elevation of people passing thereby. Accordingly, spacing between the sub-plate 14 and pier base 28 is a function of the distance between the structural pole 12 and a populated area proximate thereto. After a preferred spacing of the speaker assembly is adjusted by nuts 32 or other suitable spacers, the structural pole 12 is placed atop the sub-plate 14 and the nuts 34 are fastened to the J-bolts 30.

The preferred speaker 16 is a cone speaker, more particularly a 4 to 6 inch diameter cone speaker. Typically, a four inch cone speaker is adequate in size to provide a sufficient amplitude of acoustical vibrations therefrom, yet small enough to enclose the speaker assembly 10 within the structural pole 12. The cone speaker 16 provides acoustical vibrations that reflect from the pier base 28 omnidirectionally, thus providing sound reproduction in a 360 degree range about a structural pole 12. The invention contemplates various speakers and speaker arrangements for directing acoustical vibrations omnidirectionally, unidirectionally or in focused patterns or regions.

In order to provide aesthetic continuity to the structural pole 12 and speaker assembly 10, an acoustically transparent skirt 36 is provided between the sub-plate 14 and the pier base 28. The skirt 36 is formed by a metal screen or the like which overlays the spacing provided while permitting sound to pass therethrough. The skirt 36 also prevents tampering with the structural pole 12 and speaker assembly 10.

Figure 3:
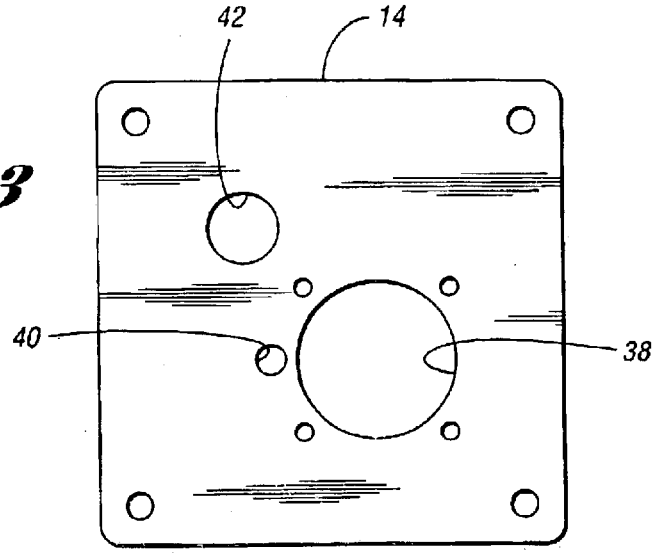
FIG. 3 is a top plan view of a sub-plate of the speaker assembly of FIG. 1.

With reference now to FIG. 3, the sub-plate 14 is illustrated in further detail. The sub-plate 14 is preferably formed from an acoustically inert material such as a fiberglass impregnated resin that is not resonate, thus providing a sound baffle between the speaker assembly 10 and the structural pole internal cavity 22. The sub-plate 14, employed as a sound baffle, prevents acoustical vibrations provided by the speaker 16 from reflecting off the pier base 28 and passing within the structural pole internal cavity 22. The sub-plate 14 also reduces unwanted vibrations or resonance from the structural pole 12.

As described earlier, the sub-plate 14 matches the footprint of the mounting flange 24 and includes a similar hole pattern. The sub-plate 14 also includes a speaker aperture 38 for permitting acoustical vibrations to pass from the speaker 16 through the sub-plate 14. The speaker aperture 38 includes a mounting hole pattern oriented thereabout for fastening the speaker 16 and/or the resonating chamber member 18 thereto. Adjacent to the speaker aperture 38 is a port aperture 40 in communication with the tubular port 20 for venting the resonating chamber internal cavity 26. Port 20 is preferably provided by an elongate tube having one end connected to the resonating chamber member internal cavity 26 and the other end affixed to the sub-plate 14 directed downward toward the pier base 28.

The speaker aperture 38 and associated hole pattern are spaced generally off-center relative to the sub-plate 14 and structural pole 12. This offset is to provide clearance within the structural pole internal cavity 22 for other objects or components that may be housed in the structural pole 12, such as a wire harness for powering a light or sign supported by the structural pole 12. In order to provide such clearance, the resonating chamber member 18 includes a non-straight portion such that an uppermost region of the resonating chamber member 18 may extend within a narrowing region of the structural pole 12. In order to permit the wire harness W or the like to enter the structural pole internal cavity 22, the sub-plate 14 includes a clearance aperture 42 such that the wire harness or the like may be displaced therethrough. In order to prevent acoustical vibrations to pass through the clearance aperture 42, a grommet or sealant may be disposed within the clearance aperture 42 for providing a generally sound type connection therein. The sub-plate 14 may also include an aperture for the speaker wiring, or the speaker wiring may be included in the wire harness passing through the clearance aperture 42, and may reach the speaker through an aperture (not shown) formed in the resonating chamber member 18.

With reference again to FIGS. 1 and 2, the resonating chamber member 18 is discussed in greater detail. The resonating chamber member is sized to match the speaker 16. The ideal volume of the resonating chamber internal cavity 26 is predicted as the function of a speaker radius. This volume is calculated using the formula $V=2\ \pi rK$, wherein V is volume, r equals the speaker radius and K is a factor of 4.51 $cm^2$. Therefore, the four inch cone speaker of the preferred embodiment requires a resonating chamber member internal cavity 26 having a volume of 144 cubic centimeters. In order to maximize the size of the speaker 16 and the structural pole internal cavity 22, the resonating chamber member 18 is generally elongated extending upward within the narrowing region of the structural pole 12. For resonance, sound quality and structural rigidity, the resonating chamber member 18 is preferably formed having a generally thick tubular wall formed of rigid plastic pipe, such as polyvinyl-chloride pipe having a wall thickness of 0.100 to 0.300 inches commonly used in the plumbing industry and the associated caps and elbows. The bent portion within the length of the resonating chamber member 18, allows the resonating chamber member 18 to be oriented generally off-center within the structural pole 12, and provides stiffening support for reducing vibration thereof. The resonating chamber member 18 further includes a sound dampening material 44, preferably spun fiberglass, for dampening vibrations imparted upon the resonating chamber member 18.

The preferred resonating chamber member 18 may be formed from a plurality of components for assembly within the structural pole 12. This feature allows the speaker assembly 10 to be retrofitted or installed within an existing structural pole 12 without having to remove the structural pole 12. As illustrated in FIG. 2*a*, the resonating chamber member 18, includes a plurality of components, specifically, a fixed region 18*a*, an offset region 18*b*, and a closed region 18*c*. These regions may have ends sized to receive one another and may be assembled by fasteners or a PVC-bonding adhesive or the like. Accordingly, if a tubular port 20 is desired, it may be formed by a vented end 20*a* and a port end 20*b*. Additionally, the sub-plate 14 may include open ended slots rather than holes sized to receive the J-bolts 30, such that the structural pole 12 does not need to be uninstalled temporarily.

The resonating chamber member 18 and corresponding port 20 may alternatively be formed integrally by a pair of injection molded half pieces that are oriented together in a clam shell manner and friction welded or vibratory welded together. Thereafter, the sound dampening material may be applied within the resonating chamber member internal cavity 26. The resonating chamber member 18, speaker 16 and sub-plate 14 may each be interconnected by fastening one to another, or they may share an aligned hole pattern such that one set of fasteners interconnects these components.

The speaker assembly 10 may be provided as an aftermarket product that may be installed in a series of existing structural poles. Pole manufacturers typically utilize common or standardized designs, thus requiring a limited variety of speaker assemblies to satisfy the aftermarket needs of the art. For example, light pole manufacturers tend to utilize hole patterns having either an eight inch bolt center, or a ten inch bolt center. Therefore, an aftermarket speaker assembly to be utilized with light poles must offer a speaker assembly for each bolt center. Accordingly, the sub-plate. 14 would match this bolt center.

The invention contemplates that the speaker assembly 10 may also be employed within a structural pole designed specifically for use in combination with the speaker assembly 10. Therefore, the invention contemplates that various components of the speaker assembly 10 may be formed integrally within the structural pole internal chamber 22. For example, the resonating chamber member internal cavity 26 may be formed within a region of the structural pole internal cavity 22. Alternatively, the sub-plate 14 may be formed integrally with the structural pole 12 or may be secured to the structural pole internal cavity 22 rather than being mounted adjacent to its fixed end.

In accordance with the teachings of the present invention, a variety of methods may be employed for conveying sound reproduction signals to the transducer or speaker 16 of the speaker assembly 10. For example, a low voltage cable may be run to each structural pole in a given speaker system. There is also a possibility of disposing a transformer within the structural pole internal cavity 22 such that the speaker assembly 10 may receive line voltage that may already be intended or provided to the structural pole 12 as a power source to other components supported thereby. A receiver may also be oriented within the structural pole internal cavity 22 for receiving a prescribed radio frequency rather than receiving a hard wired, delivered signal.

Figure 4:
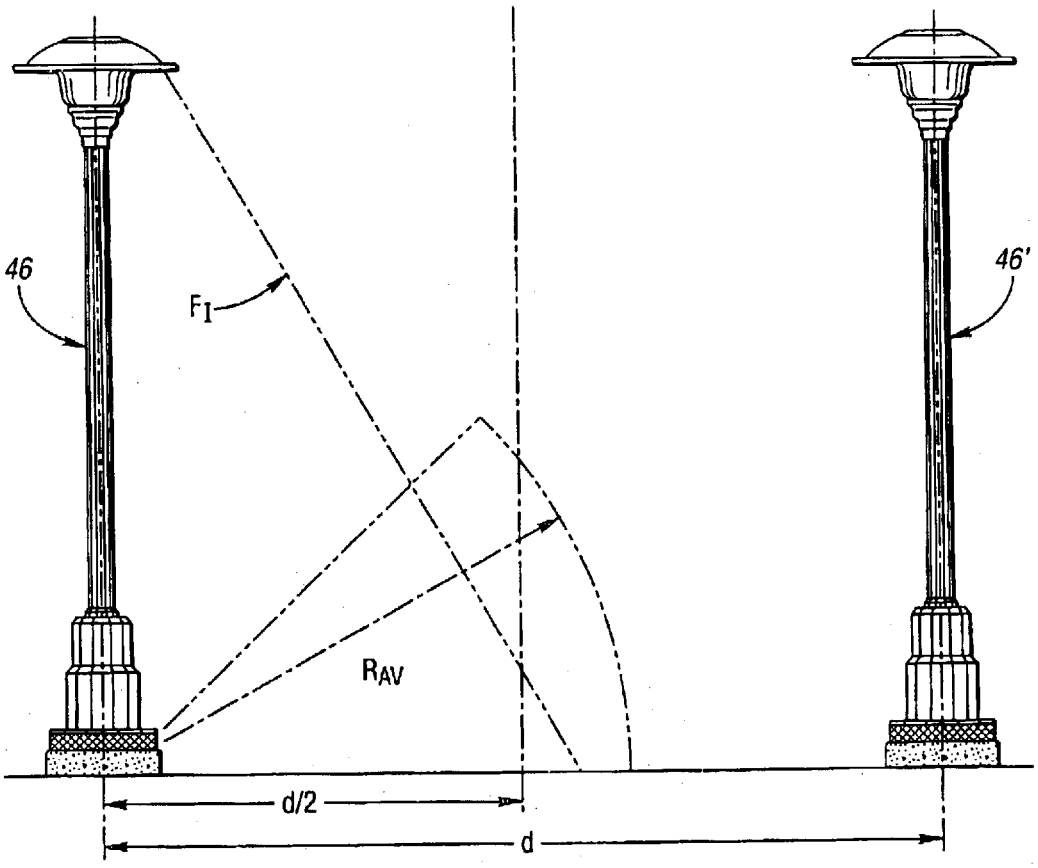
FIG. 4 is a schematical elevation view of a speaker system in accordance with the present invention.

Referring now to FIG. 4, a speaker system is illustrated in accordance with the present invention. The speaker system includes a series of spaced apart structural poles, illustrated as light poles and referenced generally by numeral 46. Each light pole 46 has an enclosed speaker assembly (not shown) installed therein. Each light pole 46 also includes an acoustical outlet region provided by the spacing between the speaker assembly 10 and the underlying support surface. The pair of light poles 46, 46' illustrated represent two of a series of light poles within the speaker system. The incremental spacing between the pair of light poles 46 has a dimension, d. Typically light poles 46, 46' are spaced such that the field of illumination, referenced generally by $F_I$, intersects the field of illumination of the neighboring light pole 46'. Therefore, the field of illumination $F_I$ of light pole 46 intersects the midpoint between the light poles 46, 46'. The midpoint between these light poles 46, 46' is illustrated by a phantom line and dimensioned by d/2. The light poles 46, 46' are spaced having interconnecting fields of illumination $F_I$, so that a passerby traveling along a path illuminated by a system of light poles perceives a continuously illuminated path of travel. Therefore, in order to compliment the continuous field of illumination with a continuous range of audible sound reproduction, the speaker assembly 10 is designed to have a range of acoustical vibrations $R_{AV}$ that also intersects the midpoint between the pair of light poles 46, 46'. Accordingly, the range of acoustical vibrations provided by a first light pole 46 intersects the range of acoustical vibrations $R_{AV}$ of a following light pole 46'. Therefore, as a passerby surpasses each light pole 46, the passerby perceives both sight and sound that is appealing to the senses and that is untainted by the visual appearance of unsightly conventional speaker assemblies.

Figure 5:
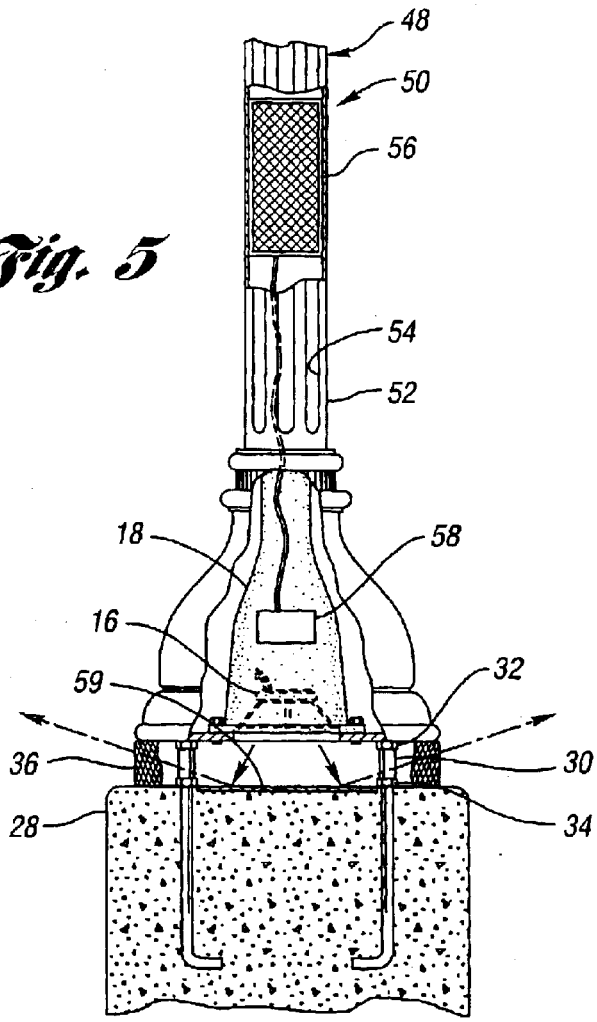
FIG. 5 is a side partial section view of an alternative embodiment structural pole and speaker system in accordance with the present invention.
Figure 5A:
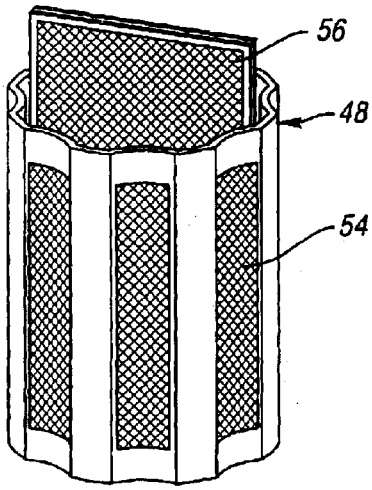
FIG. 5*a* is an enlargement of a section of the pole in FIG. 5.

With reference now to FIGS. 5 and 5*a*, an alternative embodiment structural pole 48 and speaker assembly 50 is illustrated in accordance with the present invention. Structural pole 48 is similar to that of prior embodiments, however structural pole 48 includes a generally cylindrical pole 52 including a series of recessed flutes 54 formed thereabout. The cylindrical pole 52 includes a second speaker 56 oriented therein. The second speaker 56 is a generally planar electrostatic speaker that is used in combination with the cone speaker 16 having an associated resonating chamber member 18 oriented adjacent to a fixed end of the structural pole 48. The electrostatic speaker 56 provides acoustical vibrations within a range of wavelengths that is generally smaller than that of the cone speaker 16. The electrostatic speaker 56 is oriented within the cylindrical pole 52 proximate to an average head elevation for laterally conveying the acoustical vibrations therefrom. Accordingly, as shown in FIG. 5*a*, the flutes 54 within the cylindrical pole 52 include an acoustically transparent regions oriented about the electrostatic speaker 56 for permitting acoustical vibrations to pass therethrough.

The electrostatic speaker 56 and the cone speaker 16 provide a range of acoustical vibration wavelength transmitted from the structural pole 50 for a high quality sound reproduction experience to be perceived by an ongoing passerby. The speaker assembly 50 may include a control device 58 oriented within the structural pole 48 for controlling the signals transmitted to the pair of transducers, the cone speaker 16 and the electrostatic speaker 56.

The structural pole 48 illustrates another method of fastening the structural pole 48 to the pier base 28. The method is similar to that of the prior embodiment illustrated in FIGS. 1 and 2, however the J-bolts 30 are oriented within the skirt 36 such that they are concealed from the view of a passerby. The structural pole 48 may include removable access panel for reaching the internal hardware. The speaker assembly 50 further includes a reflector 59 oriented upon the pier base 28 for predictable reflection of acoustical vibrations from the cone speaker 16.

Figure 6:
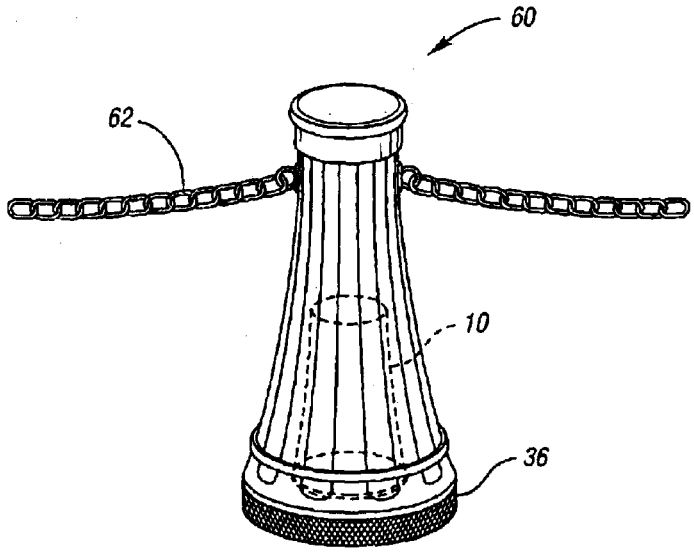
FIG. 6 is a side elevation view of another alternative embodiment structural pole and speaker system in accordance with the present invention.

Referring now to FIG. 6, an alternative embodiment the structural pole 60 is illustrated in accordance with the present invention utilizing a speaker assembly 10 oriented therein. Unlike the prior embodiment structural poles, the structural pole 60 is illustrated as a bollard having a chain 62 for connecting the bollard 60 with other bollards within a series. Bollards are typicaly utilized at waterfronts or other public areas wherein it may be desired to provide a physical barrier to prevent passersby from approaching a marked off area. The series of bollards may also provide a path or walkway for pedestrians to walk therealong.

In summary, the present invention provides a simplified speaker assembly for enclosure within a structural pole and for conveying acoustical vibrations within a public area.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A speaker assembly for enclosure within a structural pole, the speaker assembly comprising:

a sub-plate adapted to be affixed to a structural pole adjacent to an internal cavity formed in a fixed end of the structural pole;

a speaker mounted to the sub-plate and oriented such that acoustical vibrations provided by the speaker are directed toward an underlying support surface of the structural pole; and a resonating chamber member having a wall defining an elongated internal cavity oriented within the structural pole internal cavity, the resonating chamber member having an open end mounted adjacent to the speaker, and the resonating chamber member internal cavity being sized to match the speaker.

2. The speaker assembly of claim 1, wherein the speaker is sealingly engaged with the resonating chamber member open end to prevent a vibrational overdrive to the speaker.

3. The speaker assembly of claim 1, further comprising a tubular port connected to the resonating chamber member in communication with the resonating chamber member internal cavity, the port being sized to provide fluid resistance to air entering and exiting the resonating chamber member internal cavity in response to acoustical vibrations provided by the speaker.

4. The speaker assembly of claim 1, wherein the speaker is directed towards the underlying support surface for transmitting the acoustical vibrations omnidirectionally.

5. The speaker assembly of claim 1, wherein the speaker assembly is tuned by adjusting the distance between the speaker and the underlying support surface.

6. The speaker assembly of claim 1, wherein the structural pole is further defined as a light pole.

7. The speaker assembly of claim 1, wherein the structural pole is further defined as a bollard.

8. The speaker assembly of claim 1, wherein the speaker is further defined as a cone speaker.

9. The speaker assembly of claim 1, wherein the sub-plate defines a sound baffle between the speaker assembly and the structural pole internal cavity.

10. The speaker assembly of claim 1, wherein the sub-plate includes an aperture sized to permit a wire harness to pass therethrough.

11. The speaker assembly of claim 1, wherein the speaker and resonating chamber member are oriented generally off-center within the structural pole.

12. The speaker assembly of claim 1, wherein the resonating chamber member is generally tubular.

13. The speaker assembly of claim 1, wherein the resonating chamber member wall is formed of rigid polyvinylchloride pipe having a wall thickness of 0.100 to 0.300 inches.

14. The speaker assembly of claim 1, wherein the resonating chamber member includes a sound dampening material.

15. The speaker assembly of claim 1, wherein the resonating chamber is defined as a plurality of components adapted to be assembled together within the structural pole.

16. The speaker assembly of claim 1, further comprising a second speaker disposed within the structural pole internal cavity, spaced apart from the fixed end, wherein the structural pole includes an acoustically transparent region oriented about the second speaker.

17. The speaker assembly of claim 1, wherein the fixed end of the structural pole is spaced apart from the underlying support surface.

18. The speaker assembly of claim 17, further comprising an acoustically transparent skirt having a first circumferential end cooperating with the fixed end of the structural pole, and a second circumferential end cooperating with the underlying support surface.

19. A speaker assembly and a structural pole, in combination, comprising:

a structural pole having an internal cavity and a fixed end mounted to an underlying support surface, the fixed end having an acoustical outlet region for permitting acoustical vibrations to pass therethrough;

a speaker mounted to the structural pole adjacent to the internal cavity formed in the fixed end of the structural pole and oriented such that acoustical vibrations provided by the speaker are directed toward the underlying support surface of the structural pole; and a resonating chamber member having a wall defining an elongated internal cavity oriented within the structural pole internal cavity, the resonating chamber member having an open end mounted adjacent to the speaker, and the resonating chamber member internal cavity being sized to match the speaker.

20. A speaker system comprising:

a series of spaced apart structural poles, each having an internal cavity and a fixed end mounted to an underlying support surface, the fixed end having an acoustical outlet region for permitting acoustical vibrations to pass therethrough, each structural pole having a speaker assembly enclosed at least partially therein; and each speaker assembly including:

a speaker mounted to the structural pole adjacent to the internal cavity formed in the fixed end of the structural pole, the speaker being oriented such that acoustical vibrations provided by the speaker are directed toward the underlying support surface of the structural pole, and a resonating chamber member having a wall defining an elongated internal cavity oriented within the structural pole internal cavity, the resonating chamber member having an open end mounted adjacent to the speaker, the resonating chamber member internal cavity be sized to match the speaker.

21. The speaker system of claim 20, wherein each speaker assembly has an acoustical range greater than half of the incremental distance between the structural poles.

22. A method for mounting a speaker assembly within a structural pole, the method comprising:

installing a speaker and resonating chamber member within an internal cavity formed in a fixed end of a structural pole, the speaker being oriented such that acoustical vibrations provided by the speaker are directed toward an underlying support surface of the structural pole; and adjusting the pole and speaker a distance above the underlying support surface to provide an annular opening from which acoustical vibrations are omnidirectionally dissipated.

23. The speaker assembly of claim 1, wherein the resonating chamber member is structurally isolated from the structural pole and the resonating chamber internal cavity is substantially enclosed within and separated from the structural pole internal cavity by the resonating chamber member wall so that backward acoustical vibrations created by the speaker are prevented from exiting the resonating chamber member internal cavity into the structural pole internal cavity.

24. The speaker assembly of claim 1, wherein the speaker assembly is at least partially concealed within the structural pole to avoid disrupting an aesthetic appearance of the structural pole.

25. The speaker assembly of claim 1, wherein the speaker assembly is at least partially concealed within the structural pole thereby reducing exposure to vandalism and elements of nature.

26. The speaker assembly of claim 1, wherein the structural pole supports another assembly at an elevated orientation relative to the speaker assembly.

* * * * *